US009161637B2

(12) United States Patent
Chen

(10) Patent No.: US 9,161,637 B2
(45) Date of Patent: Oct. 20, 2015

(54) PLAYARD FRAME AND HANDRAIL DEVICE THEREOF

(71) Applicant: Ying-Zhong Chen, Guangdong (CN)

(72) Inventor: Ying-Zhong Chen, Guangdong (CN)

(73) Assignee: BP Children's Products HK Co., Limited, Kwai Chung, N.T. (HK)

( * ) Notice: Subject to any disclaimer, the term of this patent is extended or adjusted under 35 U.S.C. 154(b) by 4 days.

(21) Appl. No.: 14/071,665

(22) Filed: Nov. 5, 2013

(65) Prior Publication Data

US 2015/0001455 A1 Jan. 1, 2015

(30) Foreign Application Priority Data

Jul. 1, 2013 (CN) ..... 2013 1 0272147

(51) Int. Cl.
*A47D 13/06* (2006.01)

(52) U.S. Cl.
CPC ..... *A47D 13/066* (2013.01)

(58) Field of Classification Search
CPC ..... A47D 13/06
USPC ..... 5/93.1, 94, 99.1, 655
See application file for complete search history.

(56) References Cited

U.S. PATENT DOCUMENTS 3,786,524 A * 1/1974 Mathou ..... 5/100
2007/0067907 A1* 3/2007 Chen et al. ..... 5/99.1

FOREIGN PATENT DOCUMENTS

GB 2 284 988 A 6/1995
GB 2 454 992 A 5/2009

* cited by examiner

*Primary Examiner* — Fredrick Conley
(74) *Attorney, Agent, or Firm* — Winston Hsu; Scott Margo

(57) ABSTRACT

The present invention is to disclose a handrail device adapted for a playard frame, and the handrail device includes a handrail, a connecting component, and an engaging structure for detachably connecting the handrail and the connecting component. The handrail is detachably connected to the connecting component and is assembled easily. Hence, it is beneficial to decrease a size of a package for packing the handrail device before being assembled, and the handrail device can be transported or stored easily.

16 Claims, 13 Drawing Sheets

PLAYARD FRAME AND HANDRAIL DEVICE THEREOF

BACKGROUND OF THE INVENTION

1. Field of the Invention

The present invention relates to a handrail device and a playard frame therewith, and more specifically, to a handrail device and a playard frame with the handrail, having a simple structure and easy assembly.

2. Description of the Prior Art

A playard is a kind of beds for the infant, and a playard frame is assembled with a plurality of handrails and a plurality of columns to form a containing space, so as to allow the infant to play or sleep in the playard. Therefore, the playard becomes more popular for parents and infants. However, a conventional connecting structure for connecting the handrails and the columns of the playard frame is complicated, so that it is inconvenient in assembling the playard frame. In addition, a package for packing the playard frame occupies a lot of space, resulting in inconvenience in transporting or storing the playard.

SUMMARY OF THE INVENTION

A purpose of the present invention is to provide a handrail device and a playard frame with the handrail device, having a simple structure and easy assembly.

In order to implement above purposes, the present invention provides a handrail device adapted for a playard frame, and the handrail device includes a handrail, a connecting component, and an engaging structure for detachably connecting the handrail and the connecting component. The handrail is detachably connected to the connecting component and is assembled easily. Hence, it is beneficial to decrease a size of a package for packing the handrail device before being assembled, and the handrail device can be transported or stored easily.

Preferably, the engaging structure includes an engaging slot and an engaging component, one of the engaging slot and the engaging component is disposed on the connecting component, the other one of the engaging slot and the engaging component is disposed on the handrail, and an engaging rib corresponding to the engaging slot is disposed on the engaging component and for engaging with the engaging slot.

Preferably, an engaging space is formed on the connecting component and adjacent to the engaging slot, the engaging component includes an engaging protrusion corresponding to the engaging space, and the engaging protrusion is engaged with the engaging space.

Preferably, the engaging protrusion is engaged with the engaging space in an axial direction of the handrail, and the engaging rib is engaged with the engaging slot in a radial direction of the handrail.

Preferably, a resilient component is disposed on the engaging component, and the engaging protrusion is disposed on the resilient component.

Preferably, an upper end of the resilient component and the engaging component are integrally formed, and a lower end of the resilient component extends to form an operating portion.

Preferably, the resilient component is a resilient clip.

Preferably, the engaging slot is formed around an outer surface of one of the connecting component and the handrail.

The present invention further provides a playard frame including a hub assembly and a plurality of columns spaced on the hub assembly separately. The playard frame further includes a plurality of handrail devices, and each handrail device is disposed on the corresponding column.

Preferably, an engaging hook is formed on each connecting component, and an upper engaging hole corresponding to the engaging hook is disposed on the corresponding column. The engaging hook is engaged with the upper engaging hole for connecting the connecting component to the corresponding column.

Preferably, the hub assembly includes a hub and a plurality of tubes. An end of each tube is pivoted to the hub, and the other end of each tube is pivoted to the corresponding column.

Preferably, a lower engaging hole is formed on each column, and the other end of each tube is pivoted to the corresponding column via a foot component. The foot component includes a supporting portion, a pivoting portion and a connecting portion. The supporting portion is for contacting against a ground. The pivoting portion is pivoted to the corresponding tube. The connecting portion is connected to the corresponding column. An engaging block corresponding to the lower engaging hole is disposed on the connecting portion, and the engaging block is engaged with the lower engaging hole as the corresponding column is inserted into the connecting portion.

Preferably, the hub assembly further includes a curved tube. An end of the curved tube is pivoted to the hub, and the other end of the curved tube bends to form a contacting portion for contacting against ground.

Preferably, at least one handrail disposed on at least one side of the playard frame is composed of two short tubes engaged with each other.

Preferably, a protruding portion is extended from one of the two short tubes, and a receiving slot corresponding to the protruding portion is formed on the other one of the two short tubes. The protruding portion is inserted into the receiving slot.

Preferably, two holes are respectively formed on a connecting position of the two short tubes, and the playard frame further includes a spring piece for engaging with the two holes to fix the two short tubes as one of the two short tubes is inserted into the other one of the two short tubes and the two holes of the two short tubes are aligned with each other.

The handrail device includes the handrail and the connecting component, and the handrail is detachably connected to the corresponding connecting component by the engaging structure. The engaging structure includes the engaging slot formed on the connecting component, and the engaging component disposed on the handrail. The engaging space is formed on the connecting component, and the engaging rib corresponding to the engaging slot and the engaging protrusion corresponding to the engaging space are disposed on the engaging component. The engaging rib is for engaging with the engaging slot, and the engaging protrusion is engaged with the engaging space. Therefore, the handrail can be detachably connected to the connecting component and is assembled easily. Hence, it is beneficial to decrease the size of the package for packing the playard frame before the playard frame is assembled, and the playard frame can be transported or stored easily. The playard frame of the present invention has advantages of the simple structure, easy operation and great convenience.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
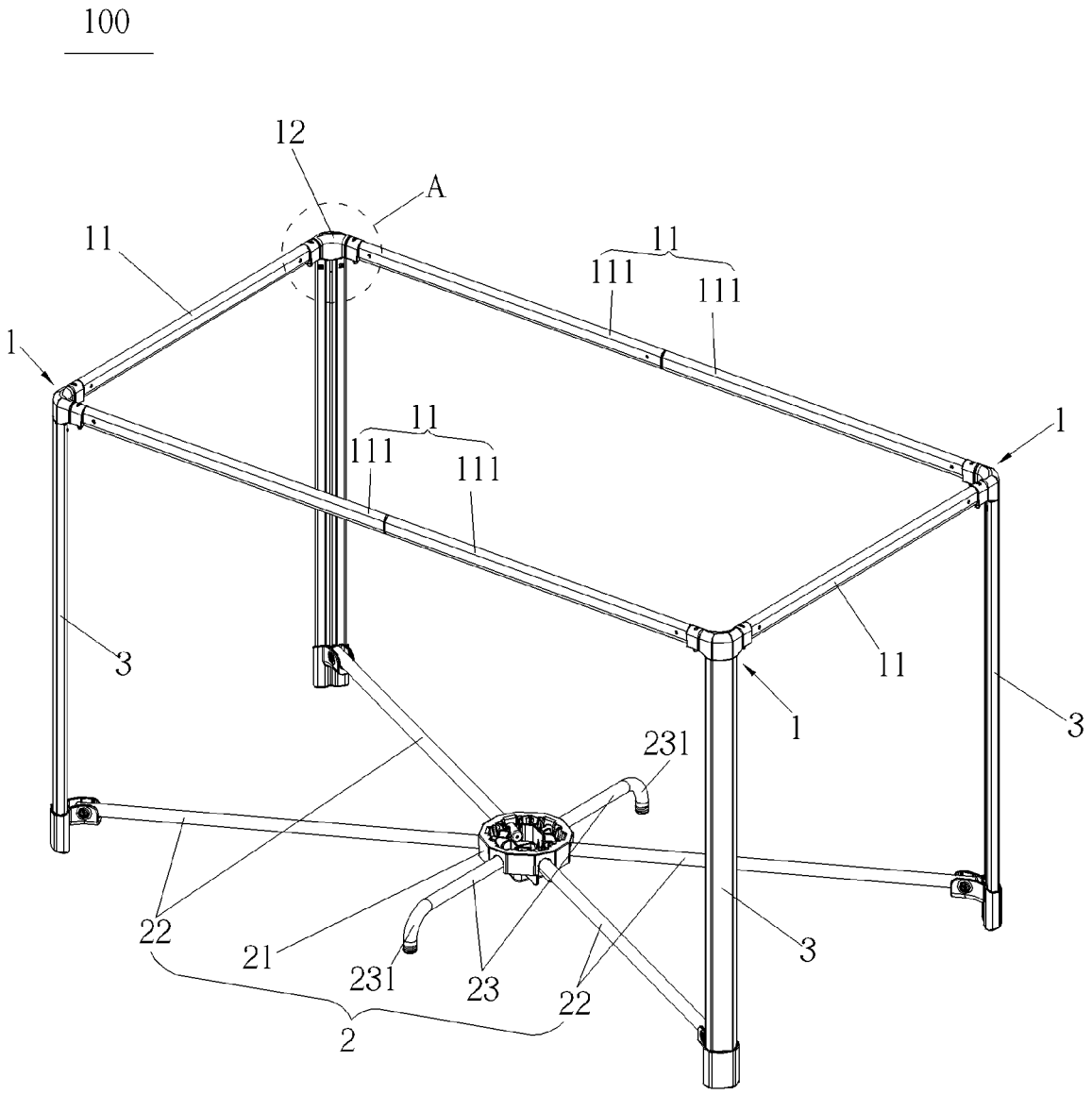
FIG. 1 is a structural diagram of a playard frame according to an embodiment of the present invention.
Figure 2:
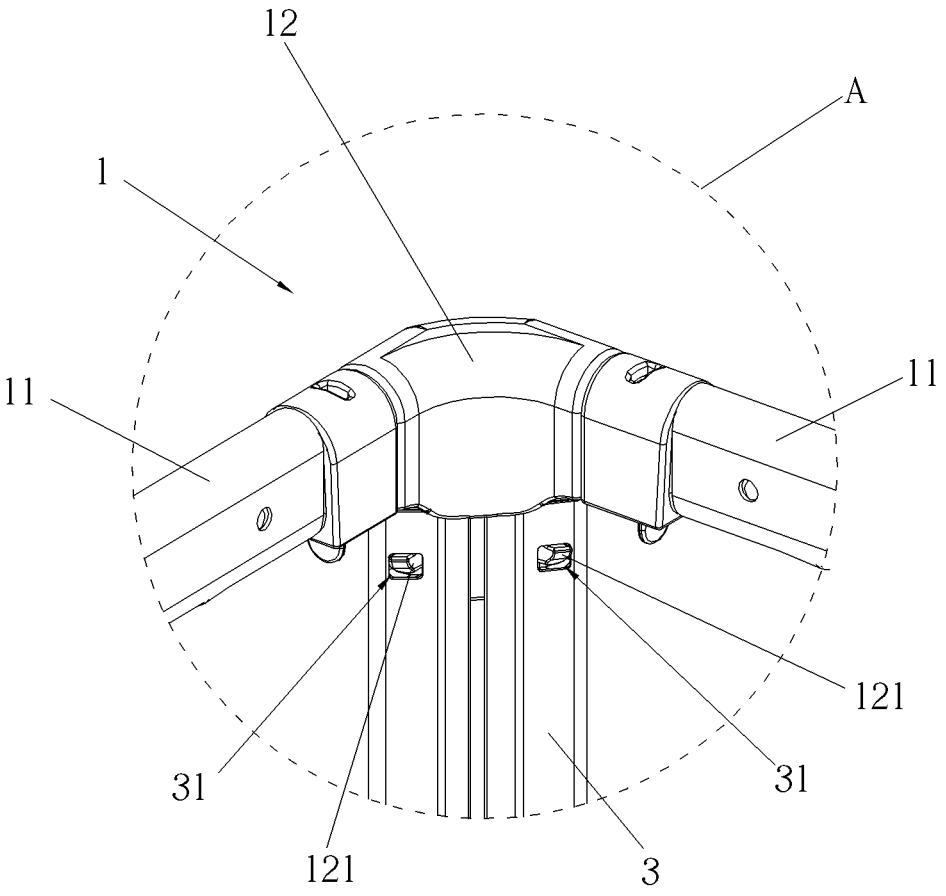
FIG. 2 is an enlarged diagram of area A illustrated in FIG. 1 according to the embodiment of the present invention.

Please refer to FIG. 1. FIG. 1 is a structural diagram of a playard frame 100 according to an embodiment of the present invention. The present invention is to provide a playard frame 100 including a plurality of handrail devices 1, a hub assembly 2 and a plurality of columns 3. The plurality of columns 3 is spaced on the hub assembly 2 separately. Each handrail device 1 includes a handrail 11 and a connecting component 12. Please refer to FIG. 2. FIG. 2 is an enlarged diagram of area A illustrated in FIG. 1 according to the embodiment of the present invention. Each connecting component 12 is disposed on the corresponding column 3. Two ends of each handrail devices 1 are connected to the corresponding connecting components 12, so as to enclose and to build up the playard frame 100.

In this embodiment, the connecting component 12 is inserted into and connected to the corresponding column 3. An engaging hook 121 is formed on each connecting component 12, and an upper engaging hole 31 corresponding to the engaging hook 121 is disposed on the corresponding column 3. The engaging hook 121 is engaged with the upper engaging hole 31 for connecting the connecting component 12 with the corresponding column 3. In this embodiment, the connecting component 12 includes two engaging hooks 121, and two upper engaging holes 31 are disposed on the column 3. The connecting component 12 is a corner component of the playard frame 100.

Figure 3:
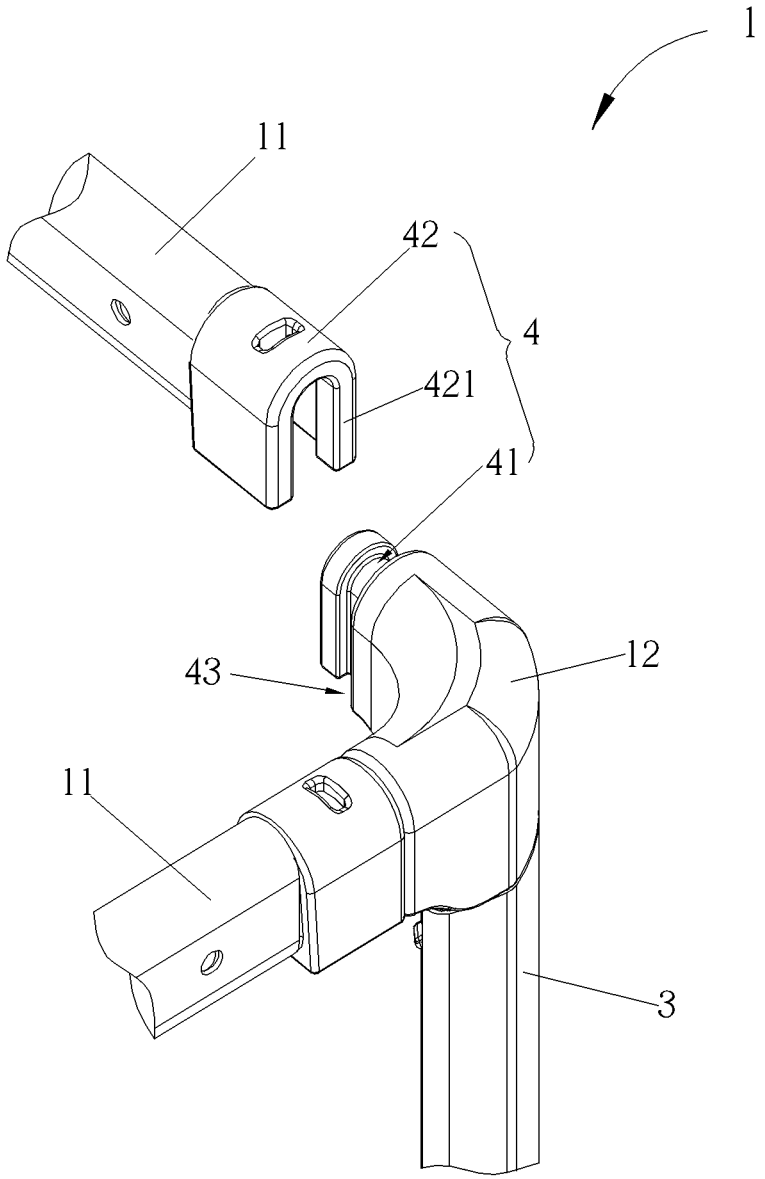
FIG. 3 is a structural diagram of a handrail device according to the embodiment of the present invention.
Figure 4:
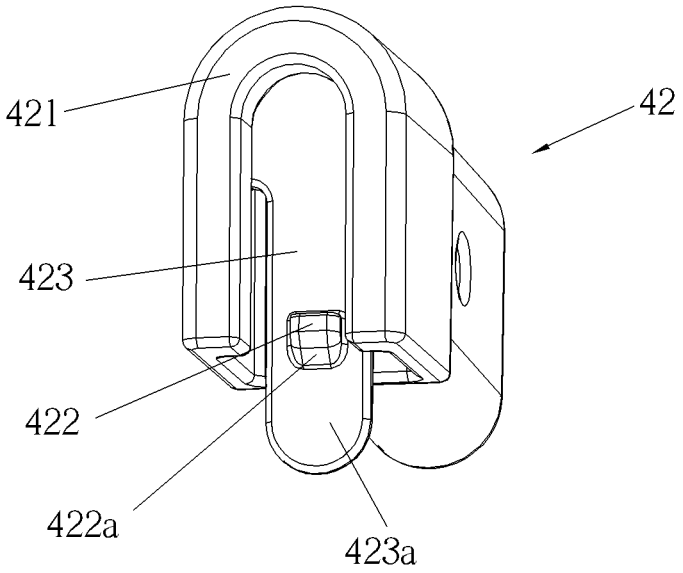
FIG. 4 is a structural diagram of an engaging component according to the embodiment of the present invention.
Figure 5:
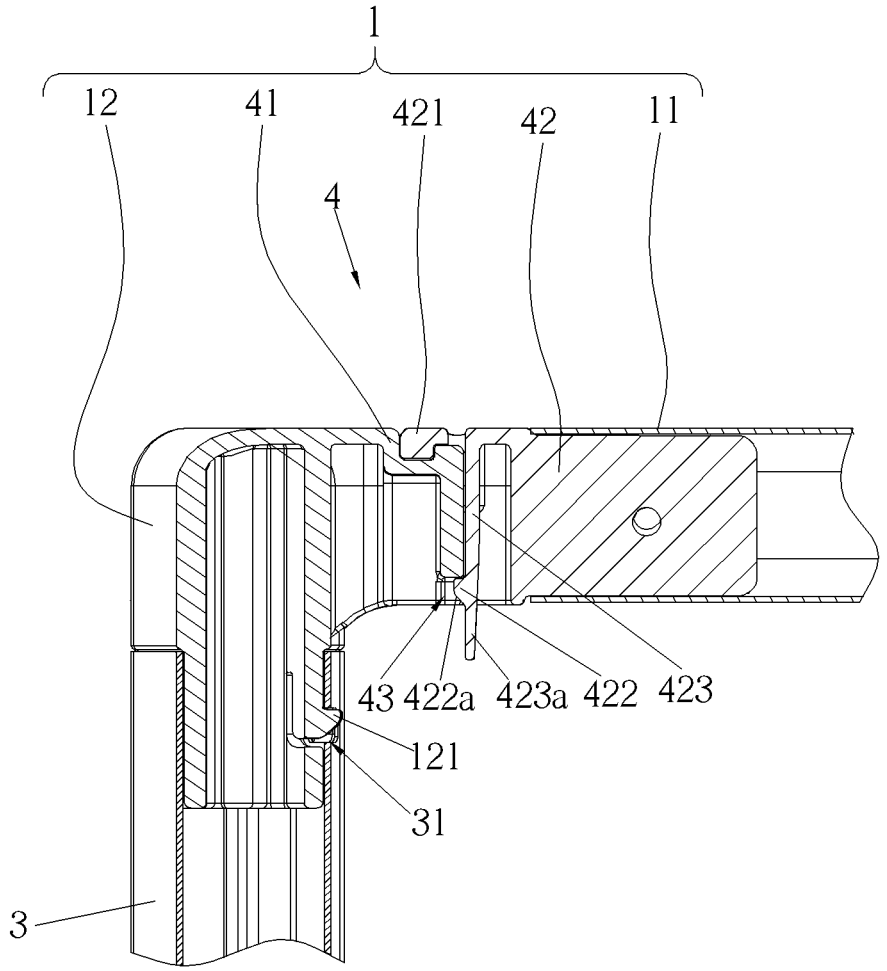
FIG. 5 is a sectional view of the handrail device according to the embodiment of the present invention.

Please refer to FIG. 3. FIG. 3 is a structural diagram of the handrail device 1 according to the embodiment of the present invention. Specifically, the handrail 11 is detachably connected to the connecting component 12 by an engaging structure 4. That is, the engaging structure 4 is for detachably connecting the handrail 11 and the connecting component 12. The engaging structure 4 includes an engaging slot 41 formed on the connecting component 12, and an engaging component 42 disposed on the handrail 11. It is noticed that positions of the engaging slot 41 and the engaging component 42 are not limited to the above-mentioned embodiment. For example, the engaging component 42 can be disposed on the connecting component 12, and the engaging slot 41 can be disposed on the handrail 11 in another embodiment. Please refer to FIG. 3 to FIG. 5. FIG. 4 is a structural diagram of the engaging component 42 according to the embodiment of the present invention. FIG. 5 is a sectional view of the handrail device 1 according to the embodiment of the present invention. As shown in FIG. 3 and FIG. 5, an engaging space 43 is formed on the connecting component 12 and adjacent to the engaging slot 41, and an engaging rib 421 corresponding to the engaging slot 41 and an engaging protrusion 422 corresponding to the engaging space 43 are disposed on the engaging component 42. The engaging rib 421 is for engaging with the engaging slot 41, and the engaging protrusion 422 is engaged with the engaging space 43. Therefore, the handrail 11 can be detachably connected to the connecting component 12 and is assembled easily. Hence, it is beneficial to decrease a size of a package for packing the playard frame 100 before the playard frame 100 is assembled, and the playard frame 100 can be transported or stored easily. The playard frame 100 has advantages of the simple structure, easy operation and great convenience.

In this embodiment, the engaging space 43 can be a bottom edge of the connecting component 12, but is not limited to it. For example, the engaging space 43 can also be a concave or an opening of the connecting component 12. Structures for engaging with the engaging protrusion 422 are within the scope of the present invention.

Preferably, the engaging protrusion 422 is engaged with the engaging space 43 in an axial direction of the handrail 11, and the engaging rib 421 is engaged with the engaging slot 41 in a radial direction of the handrail 11. As a result, it can ensure that the handrail 11 is connected to the connecting component 12 stably, the playard frame 100 is assembled compactly, and the playard frame 100 can be utilized safely. Preferably, the engaging slot 41 is formed around an outer surface of the connecting component 12 and formed as an n-shaped structure.

A resilient component 423 is disposed on the engaging component 42, and the engaging protrusion 422 is disposed on the resilient component 423. A surface 422*a* is formed on a side of the engaging protrusion 422 for facilitating the engaging space 43 to engage with the engaging protrusion 422. An upper end of the resilient component 423 and the engaging component 42 are integrally formed, and a lower end of the resilient component 423 extends to form an operating portion 423*a* freely. As the handrail 11 is to be detached from the connecting component 12, it only needs to operate the operating portion 423*a*, so as to separate the engaging protrusion 422 from the engaging space 43 of the connecting component 12, and then the handrail 11 is pulled up. Therefore, the handrail 11 is easily separated from the connecting component 12. In this embodiment, the resilient component 423 can be a resilient clip.

Figure 6:
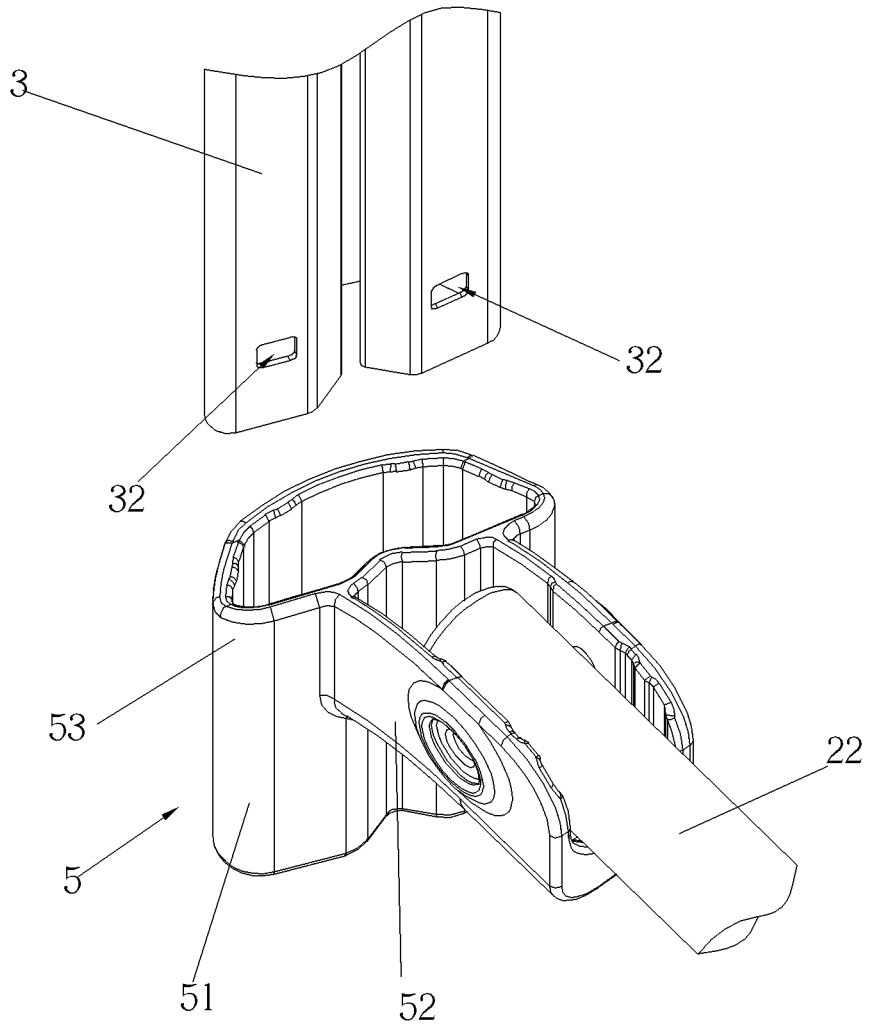
FIG. 6 is a structural diagram of a foot component, a tube and a column according to the embodiment of the present invention.
Figure 7:
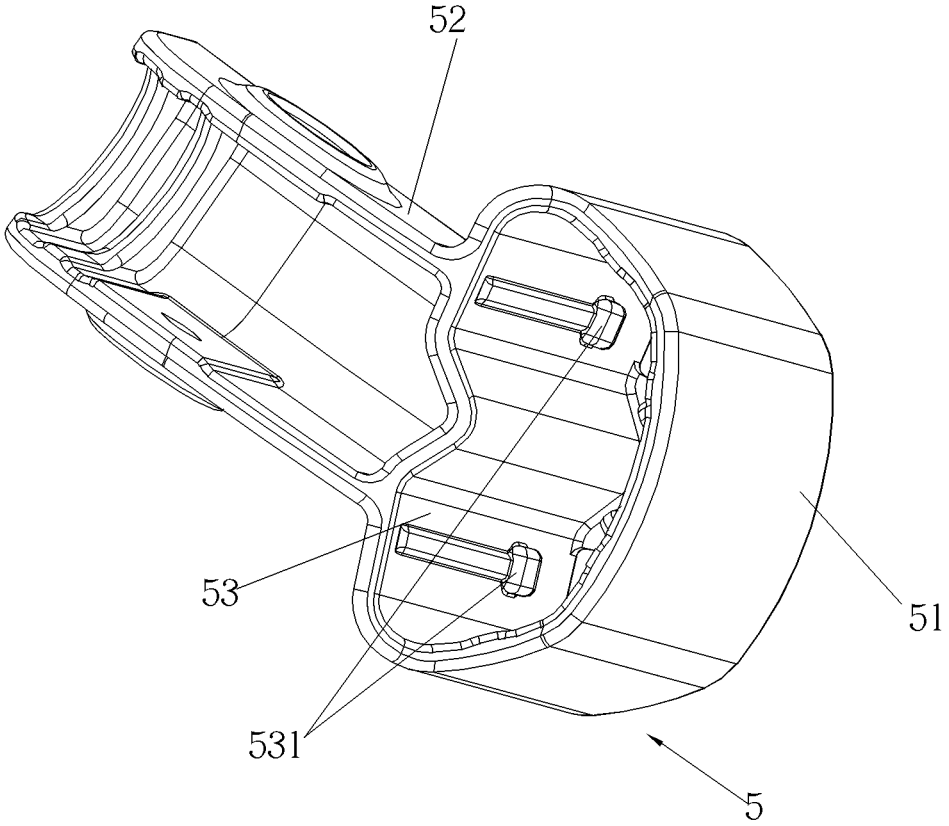
FIG. 7 is another view of the foot component according to the embodiment of the present invention.
Figure 8:
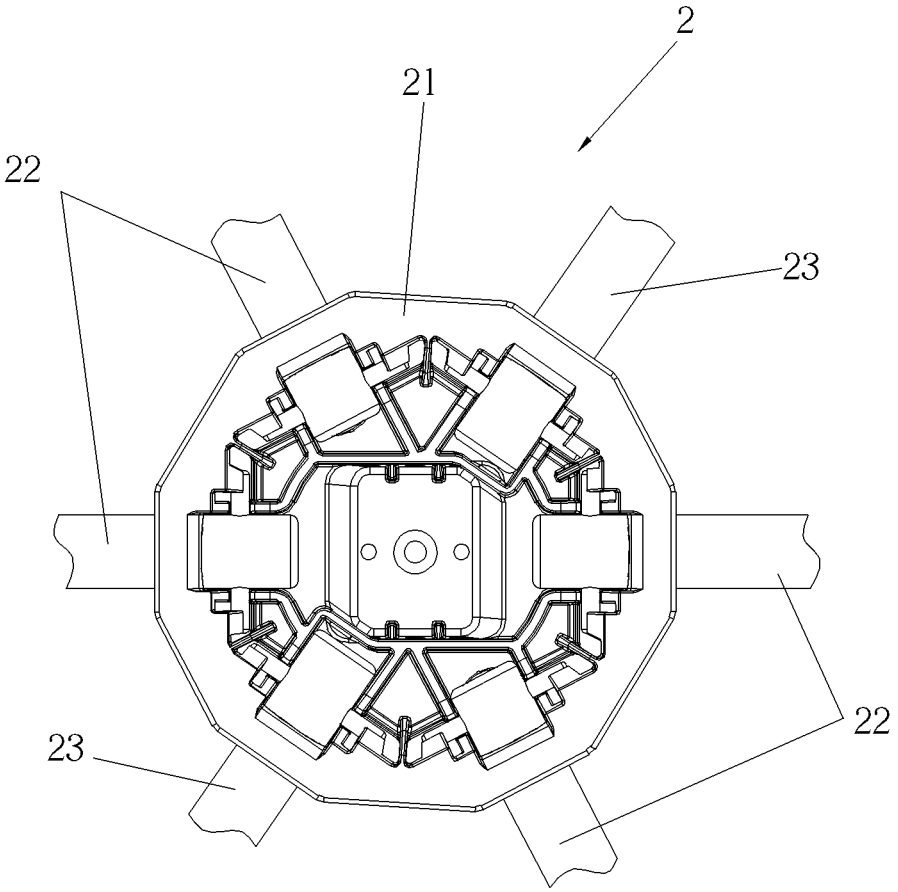
FIG. 8 is a top view of a hub assembly according to the embodiment of the present invention.
Figure 9:
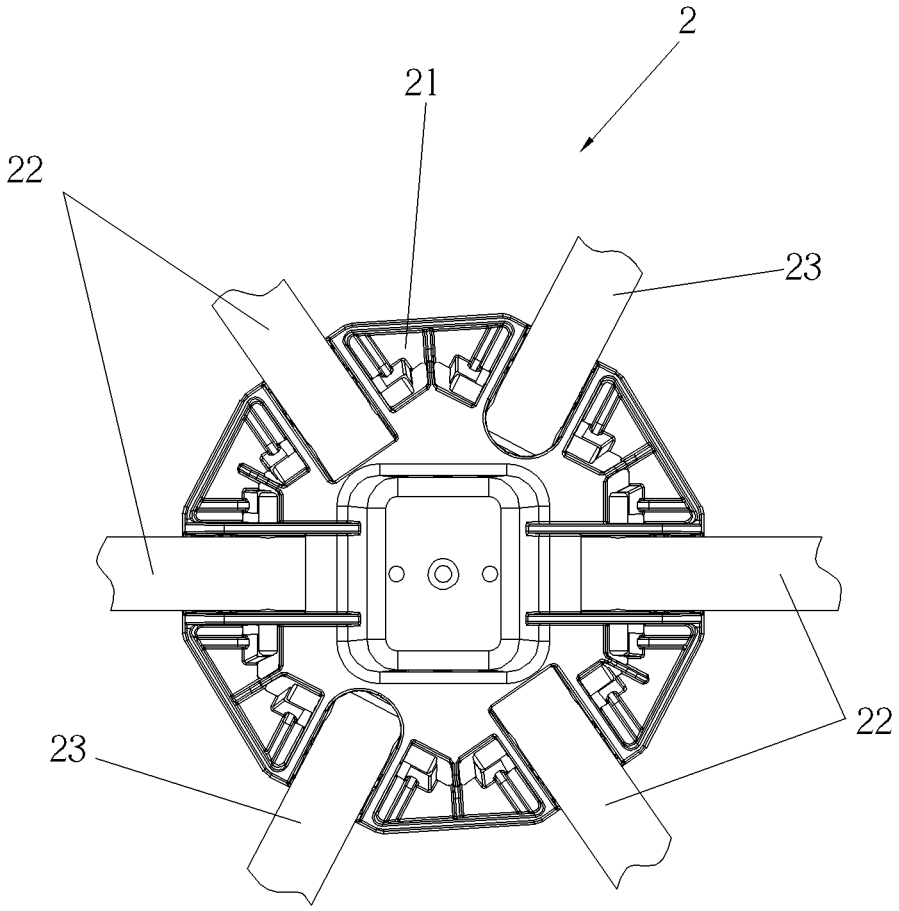
FIG. 9 is a bottom view of the hub assembly according to the embodiment of the present invention.

Please refer to FIG. 1 to FIG. 9. FIG. 6 is a structural diagram of a foot component 5, a tube 22 and the column 3 according to the embodiment of the present invention. FIG. 7 is another view of the foot component 5 according to the embodiment of the present invention. FIG. 8 is a top view of the hub assembly 2 according to the embodiment of the present invention. FIG. 9 is a bottom view of the hub assembly 2 according to the embodiment of the present invention. The hub assembly 2 includes a hub 21, a plurality of tubes 22 and a curved tube 23. An end of each tube 22 is pivoted to the hub 21, and the other end of each tube 22 is pivoted to the corresponding column 3. Specifically, as shown in FIG. 6 and FIG. 7, the other end of each tube 22 is pivoted to the corresponding column 3 via the foot component 5. The foot component 5 can be an r-shaped structure and includes a supporting portion 51, a pivoting portion 52 and a connecting portion 53. The supporting portion 51 is for contacting against a ground. The pivoting portion 52 is pivoted to the corresponding tube 22. The connecting portion 53 is connected to the corresponding column 3, and the column 3 is inserted into the connecting portion 53.

Figure 10:
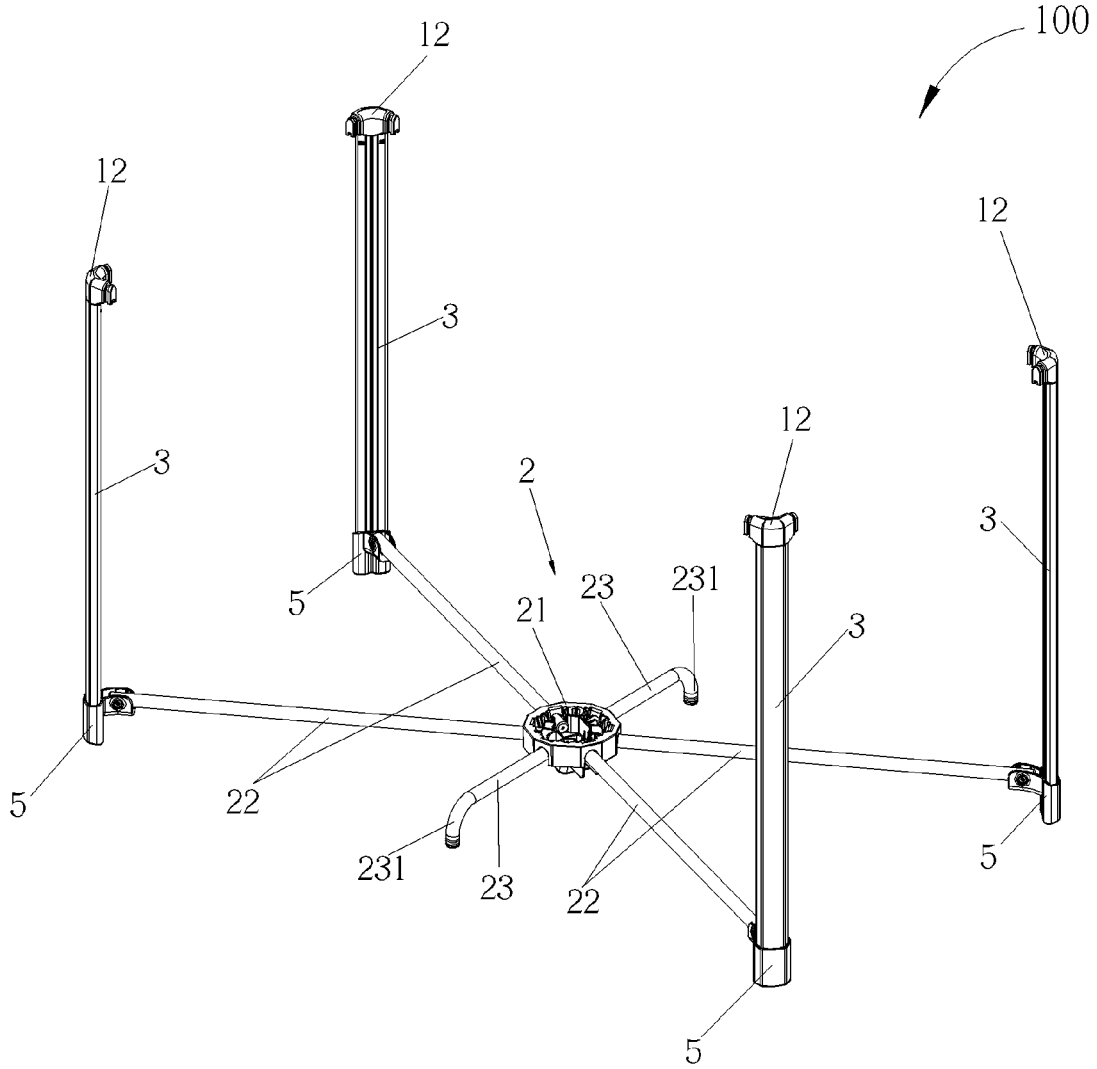
FIG. 10 is a structural diagram of the playard frame without illustrating the handrails according to the embodiment of the present invention.

A lower engaging hole 32 is formed on the column 3, and an engaging block 531 corresponding to the lower engaging hole 32 is disposed on the connecting portion 53. The engaging block 531 is engaged with the lower engaging hole 32 as the column 3 is inserted into the connecting portion 53. In this embodiment, there are two lower engaging holes 32 and two engaging blocks 531 on the column 3 and the connecting portion 53 respectively, but numbers of the lower engaging holes 32 and engaging blocks 531 are not limited to this, and it depends on practical design demands. Please refer to FIG. 1 and FIG. 10. FIG. 10 is a structural diagram of the playard frame 100 without illustrating the handrails 11 according to the embodiment of the present invention. An end of the curved tube 23 is pivoted to the hub 21, and the other end of the curved tube 23 bends to form a contacting portion 231 for contacting against the ground.

Figure 13:
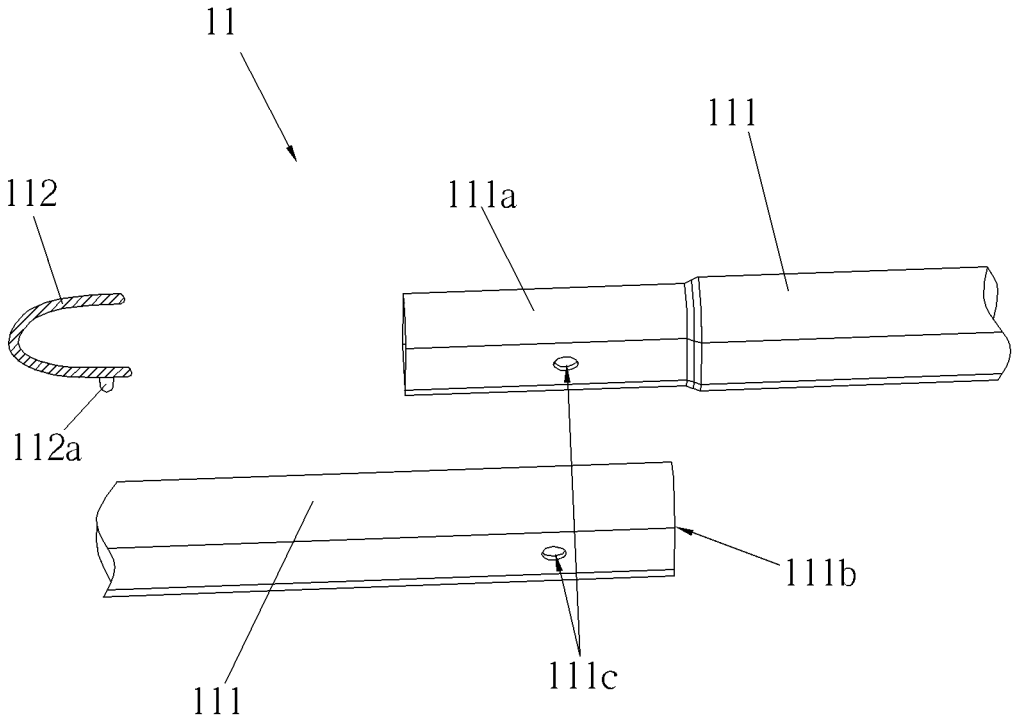
FIG. 13 is an assembly diagram of the handrail according to the embodiment of the present invention.

Please refer to FIG. 1 and FIG. 13. FIG. 13 is an assembly diagram of the handrail 11 according to the embodiment of the present invention. The two handrails 11 are disposed on two sides of the playard frame 100, and each handrail 11 is composed of two short tubes 111 engaged with each other. That is, in this embodiment, the handrails 11 are divided into long handrails and short handrails. The long handrail and the short handrail are connected to each other, so as to enclose and to build up the playard frame 100 as a square-shaped structure. The long handrail is composed of the two short tubes 111, so that it is beneficial to decrease the size of the package for packing the playard frame 100 before the playard frame 100 is assembled.

Preferably, as shown in FIG. 13, a protruding portion 111*a* is extended from one of the two short tubes 111, and a receiving slot 111*b* corresponding to the protruding portion 111*a* is formed on the other one of the two short tubes 111. The protruding portion 111*a* is inserted into the receiving slot 111*b*.

Preferably, the playard frame 100 further includes a spring piece 112 for engaging with the two short tubes 111. A protrusion 112*a* is disposed on the spring piece 112, and two holes 111*c* are respectively formed on a connecting position of the two short tubes 111. As one of the two short tubes 111 is inserted into the other one of the two short tubes 111, the two holes 111*c* of the two short tubes 111 are aligned with each other. Then, the spring piece 112 is inserted into the two holes 111*c* to fix the two short tubes 111 by engaging the protrusion 112*a* with the two holes 111*c*.

Figure 11:
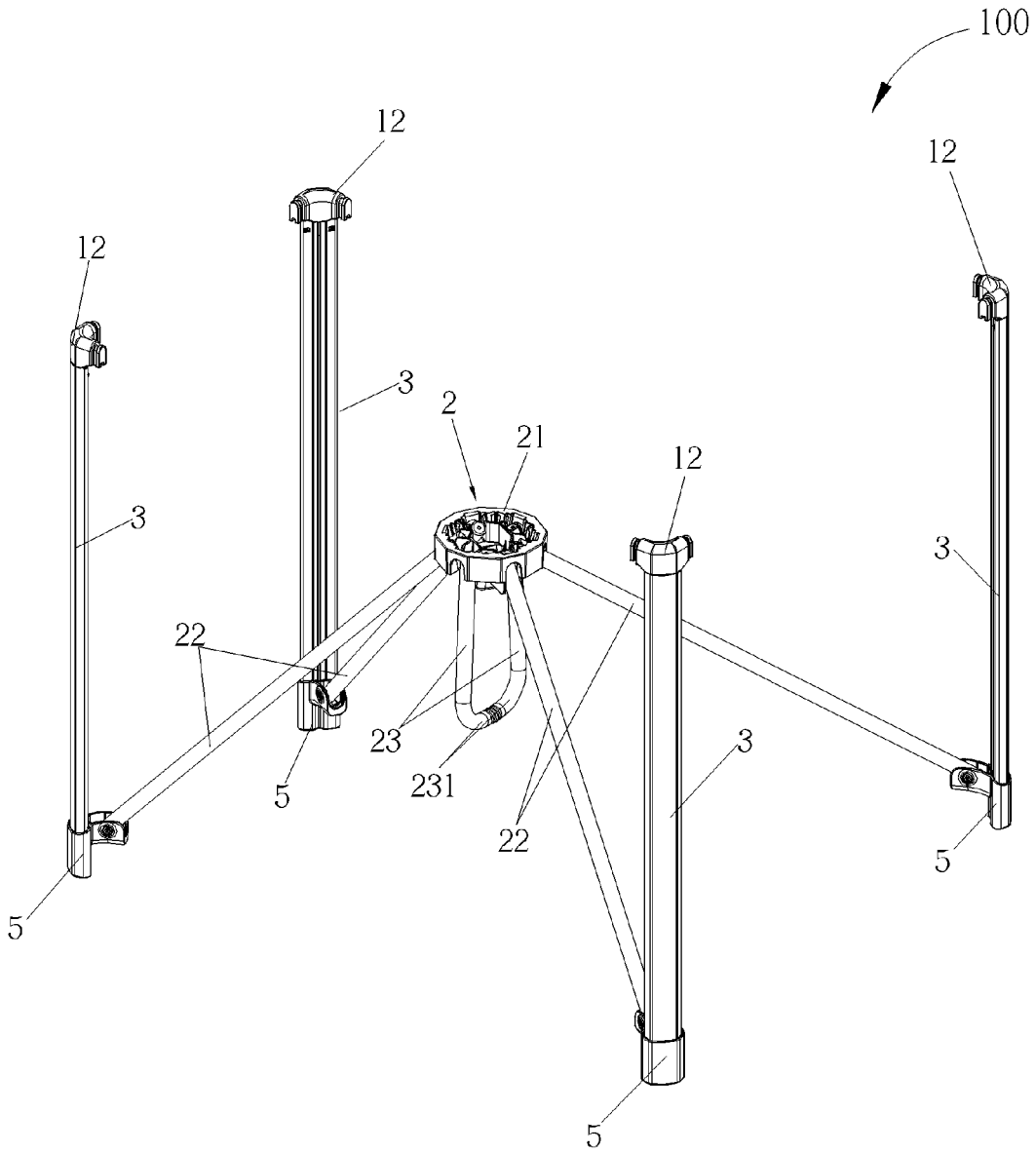
FIG. 11 is a diagram of the playard frame being folded according to the embodiment of the present invention.
Figure 12:
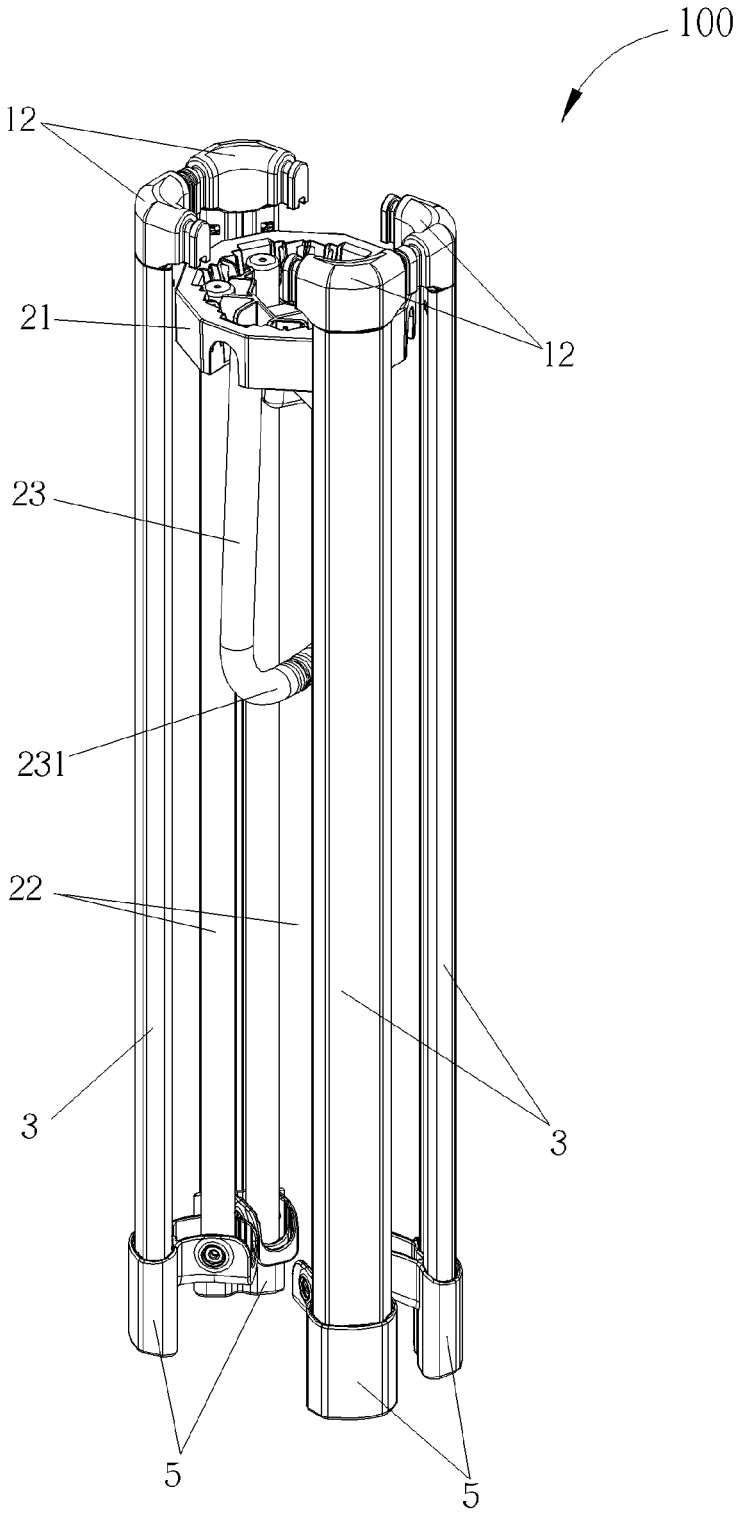
FIG. 12 is a diagram of the playard frame having been folded according to the embodiment of the present invention.

Please refer to FIG. 1 to FIG. 12. FIG. 11 is a diagram of the playard frame 100 being folded according to the embodiment of the present invention. FIG. 12 is a diagram of the playard frame 100 having been folded according to the embodiment of the present invention. As the playard frame 100 is to be folded, the handrails 11 of the playard frame 100 are detached first. That is, as shown in FIG. 5, the operating portion 423*a* is operated to separate the engaging protrusion 422 from the engaging space 43 of the connecting component 12. Then, the handrail 11 is pulled up, so that the handrail 11 is separated from the connecting component 12, as shown in FIG. 3. After that, as shown in FIG. 10 to FIG. 12, the hub 21 is pulled up, the tubes 22 and the curved tubes 23 pivot relative to the hub 21, and the tubes 22 pivot relative to the columns 3. Finally, as shown in FIG. 12, the tubes 22, the curved tubes 23 and the columns 3 are folded together. A procedure of folding the playard frame 100 is simple and convenient, so that it is beneficial to decrease the size of the package for packing the playard frame 100 before the playard frame 100 is assembled, and to be transported or be contained conveniently. As the playard frame 100 is to be assembled, it only needs to pull the columns 3 outwardly, so that the tubes 22 and the curved tubes 23 are extended completely. Then, the handrails 11 are installed on the connecting components 12 by the engaging structures 4, so as to finish a procedure of assembling the playard frame 100. It is simple and convenient to assemble the playard frame 100.

In contrast to the prior art, the handrail device 1 includes the handrail 11 and the connecting component 12, and the handrail 11 is detachably connected to the corresponding connecting component 12 by the engaging structure 4. The engaging structure 4 includes the engaging slot 41 formed on the connecting component 12, and the engaging component 42 disposed on the handrail 11. The engaging space 43 is formed on the connecting component 12, and the engaging rib 421 corresponding to the engaging slot 41 and the engaging protrusion 422 corresponding to the engaging space 43 are disposed on the engaging component 42. The engaging rib 421 is for engaging with the engaging slot 41, and the engaging protrusion 422 is engaged with the engaging space 43. Therefore, the handrail 11 can be detachably connected to the connecting component 12 and is assembled easily. Hence, it is beneficial to decrease the size of the package for packing the playard frame 100 before the playard frame 100 is assembled, and the playard frame 100 can be transported or stored easily. The playard frame 100 of the present invention has advantaged of the simple structure, easy operation and great convenience.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A handrail device adapted for a playard frame, the handrail device comprising a handrail, a connecting component, and an engaging structure for detachably connecting the handrail and the connecting component;

wherein the engaging structure comprises an engaging slot and an engaging component, one of the engaging slot and the engaging component is disposed on the connecting component, the other one of the engaging slot and the engaging component is disposed on the handrail, and an engaging rib corresponding to the engaging slot is disposed on the engaging component and for engaging with the engaging slot;

wherein an engaging space is formed on the connecting component and adjacent to the engaging slot, the engaging component comprises an engaging protrusion corresponding to the engaging space, and the engaging protrusion is engaged with the engaging space;

wherein the engaging protrusion is engaged with the engaging space in an axial direction of the handrail, and the engaging rib is engaged with the engaging slot in a radial direction of the handrail.

2. The handrail device of claim 1, wherein a resilient component is disposed on the engaging component, and the engaging protrusion is disposed on the resilient component.

3. The handrail device of claim 2, wherein an upper end of the resilient component and the engaging component are integrally formed, and a lower end of the resilient component extends to form an operating portion freely.

4. The handrail device of claim 3, wherein the resilient component is a resilient clip.

5. The handrail device of claim 1, wherein the engaging slot is formed around an outer surface of one of the connecting component and the handrail.

6. A playard frame, comprising:

a hub assembly;

a plurality of columns spaced on the hub assembly separately; and a plurality of handrail devices, each handrail device being disposed on the corresponding column, and each handrail device comprising a handrail, a connecting component, and an engaging structure for detachably connecting the handrail and the connecting component, wherein the engaging structure comprises an engaging slot and an engaging component, one of the engaging slot and the engaging component is disposed on the connecting component, the other one of the engaging slot and the engaging component is disposed on the handrail, and an engaging rib corresponding to the engaging slot is disposed on the engaging component and for engaging with the engaging slot.

7. The playard frame of claim 6, wherein an engaging space is formed on the connecting component and adjacent to the engaging slot, the engaging component comprises an engaging protrusion corresponding to the engaging space, and the engaging protrusion is engaged with the engaging space.

8. The playard frame of claim 7, wherein the engaging protrusion is engaged with the engaging space in an axial direction of the handrail, and the engaging rib is engaged with the engaging slot in a radial direction of the handrail.

9. The playard frame of claim 8, wherein a resilient component is disposed on the engaging component, and the engaging protrusion is disposed on the resilient component.

10. The playard frame of claim 6, wherein an engaging hook is formed on each connecting component, an upper engaging hole corresponding to the engaging hook is disposed on the corresponding column, and the engaging hook is engaged with the upper engaging hole for connecting the connecting component to the corresponding column.

11. The playard frame of claim 6, wherein the hub assembly comprises:

a hub;

a plurality of tubes, an end of each tube being pivoted to the hub, and the other end of each tube being pivoted to the corresponding column.

12. The playard frame of claim 11, wherein a lower engaging hole is formed on each column, the other end of each tube is pivoted to the corresponding column via a foot component, and the foot component comprises:

a supporting portion for contacting against a ground;

a pivoting portion pivoted to the corresponding tube; and a connecting portion connected to the corresponding column, an engaging block corresponding to the lower engaging hole being disposed on the connecting portion, and the engaging block is engaged with the lower engaging hole as the corresponding column is inserted into the connecting portion.

13. The playard frame of claim 11, wherein the hub assembly further comprises a curved tube, an end of the curved tube is pivoted to the hub, and the other end of the curved tube bends to form a contacting portion for contacting against a ground.

14. The playard frame of claim 6, wherein at least one handrail disposed on at least one side of the playard frame is composed of two short tubes engaged with each other.

15. The playard frame of claim 14, wherein a protruding portion is extended from one of the two short tubes, a receiving slot corresponding to the protruding portion is formed on the other one of the two short tubes, and the protruding portion is inserted into the receiving slot.

16. The playard frame of claim 15, wherein two holes are respectively formed on a connecting position of the two short tubes, and the playard frame further comprises a spring piece for engaging with the two holes to fix the two short tubes as one of the two short tubes is inserted into the other one of the two short tubes and the two holes of the two short tubes are aligned with each other.

* * * * *